US006179682B1

(12) United States Patent
Plain et al.

(10) Patent No.: US 6,179,682 B1
(45) Date of Patent: Jan. 30, 2001

(54) TEACHING TOY TELEPHONE

(75) Inventors: Barbara Plain, Des Plaines, IL (US); Wai Hing Kim, Laguna; Yau Chung Siu, Shatin, both of (HK)

(73) Assignee: Learning Resources, Inc., Vernon, IL (US)

( * ) Notice: Under 35 U.S.C. 154(b), the term of this patent shall be extended for 0 days.

(21) Appl. No.: 09/195,786

(22) Filed: Nov. 19, 1998

(51) Int. Cl.[7] ..... A63H 33/30
(52) U.S. Cl. ..... 446/141; 446/397
(58) Field of Search ..... 496/141, 142; 434/227, 230, 231; 446/397, 408, 484

(56) References Cited

U.S. PATENT DOCUMENTS 5,513,993 * 5/1996 Lindley et al. ..... 446/141 X
5,679,049 * 10/1997 Arad et al. ..... 446/408 X

OTHER PUBLICATIONS

Photograph of Fisher–Price Chatter Telephone.
Photograph of Tot Tunes Telephone Answering Machine.
Photograph of Blue Box Answer Phone.
Photograph of Playskool Talking Pay Phone.
Photograph of Barbie Super Talking Phone Answering Machine.
Photograph of Push Telephone with Saving Bank.
Mary Had A Little Lamb Telephone.

* cited by examiner

*Primary Examiner*—Sam Rimell
(74) *Attorney, Agent, or Firm*—Laff, Whitesel & Saret, Inc.

(57) ABSTRACT

An educational toy telephone is provided and includes a telephone base and a removable handset. A numerical keypad is provided by which an input telephone number may be entered into said telephone. The telephone further includes a microprocessor and memory associated therewith for controlling the various functions of the toy telephone and storing a user-defined programmed telephone number. A message controller is provided, responsive to an output signal from the microprocessor. The message controller stores at least one pre-recorded message consisting of at least one of individual tones, patterns of tones, and a voice message. The microprocessor compares telephone numbers entered into the keypad against the pre-defined telephone numbers. The message controller, responsive to the microprocessor, audibly reproduces the at least one pre-recorded message when the comparison performed by the microprocessor determines that the input telephone number matches the pre-defined telephone number.

20 Claims, 3 Drawing Sheets

TEACHING TOY TELEPHONE

BACKGROUND OF THE INVENTION

The present invention relates to toy telephones for use by children. Such toys are well known in the art and many examples may be found in toy stores. Most models include a base and a removable handset connected to the base by a cord or segment of rope. A number of buttons are generally located on the face of the telephone and a child playing with the telephone may press the various buttons while pretending to use the telephone. The base may also include a cradle for receiving the handset when the phone is not in use, mimicking an actual telephone when the receiver is "on the hook". The cradle may further include a switch which is actuated when the handset is placed in or removed from the cradle.

In some cases, a toy telephone will produce sounds such as individual musical notes, simple melodies, or even animal sounds, in response to a child pressing the various buttons on the telephone. Furthermore, the switch in the cradle may disable the buttons and sounds when the handset is placed in the cradle, or the cradle switch may cause alternate noises to be sounded when the child presses the buttons with the handset in the cradle. Brief phrases such as "Hello Let's Play!" may be repeated when the toy is turned on, or when the handset is removed from the cradle.

In general, prior art toy phones are just that, toys. They serve no other purpose than to occupy and entertain a child. There is no close correlation between the manner of playing with the toy telephone and the manner of using a real telephone. Thus, the typical toy telephone according the present state of the art does little to educate a child in how to use a telephone.

It is prudent to teach children the rudimentary aspects of using a telephone at an early age not only for educational purposes, but also for safety reasons. News stories abound wherein a child calls 911 in response to a domestic emergency and a family tragedy is averted thanks to the child's knowledge of how to call for emergency assistance. It is also important for children to learn their own telephone number, or that of a relative, at as early an age as possible so that parents or relatives can be contacted in case a problem occurs while the child is away from the home. Unfortunately, toy telephones according to the present state of the toy telephone art do not address these concerns.

Because play serves an important role in child development and learning, a toy telephone represents the ideal platform for educating children how to use a telephone. It would be desirable to introduce through a toy telephone fundamental telephone skills such as dialing 911 or a child's home telephone number, as well as to familiarize a child with other telephone concepts such as dial tone, the busy signal, and a ringing telephone. To achieve these early educational goals, a toy telephone that mimics the operation of a real telephone is required. Such an educational telephone should include a standard numbered keypad similar to that found on most phones and should operate on similar principles. For example, the keypad should be functional only when the handset is removed from the cradle and the phone should be responsive when proper emergency numbers and/or a child's home telephone number is entered. An appropriate positive response from the telephone when these various important numbers are correctly entered into the keypad will help to ingrain these numbers in the child's memory and will enhance the child's enjoyment of the toy. Further, if the numbers entered into the keypad are displayed as they are entered, a child will learn to associate the pressing of a particular button with a certain positive result. As the child's skill in using a telephone increases, the child will soon associate entire strings of numbers entered into the keypad as complete telephone numbers viewed on the display.

SUMMARY OF THE INVENTION

In light of the background given above, a primary object of the present invention is to provide a toy telephone adapted to teach children the rudimentary aspects of using a telephone.

Another other object of the invention is to provide an educational toy telephone, which teaches a child to dial 911 in the event of an emergency.

A further object of the invention is to provide an educational toy telephone which teaches a child how to reach an operator.

A still further object of the invention is to provide an educational toy telephone which facilitates teaching a child his or her own home telephone number.

Yet another object of the present invention is to provide a toy telephone which teaches basic aspects of telephone usage in an engaging and entertaining manner so as to hold the attention of an easily distracted child.

All of these objects, as well as others which will become apparent upon reading the detailed description of the preferred embodiment of the invention, are met by the teaching telephone disclosed herein.

The teaching telephone of the present invention includes a base unit and a removable handset. The base unit includes a cradle for receiving the handset. A switch located within the cradle provides indication whether the handset has or has not been removed from the base. The base further includes a numeric keypad similar to that found on most standard telephones. The keypad includes a plurality of pushbutton switches including buttons designated 0 through 9 as well as symbols "#" and "*". Additional buttons located on the face of the toy telephone base include two "Speed Dial" buttons, a program button, a record button, and a power on/off button. A liquid crystal display is also located on the base of the toy telephone along with a speaker and a microphone.

The pushbuttons on the face of the toy telephone and the cradle switch are all connected as inputs to a microprocessor located on a printed circuit board mounted within the base. In addition to receiving the pushbutton inputs, the microprocessor drives the liquid crystal display and interfaces with other components, which record, store, and play back audio messages. In the preferred embodiment of the invention these additional components comprise a message recorder and a separate message controller.

The microprocessor receives input data in the form of both sequential and contemporaneous pushbutton entries manually entered on the keypad and other buttons located on the faceplate. In response to this input data, the microprocessor generates output signals which control the display and the meaasge controller. In the preferred embodiment, the microprocessor controls the message recorder indirectly through the message controller, however, alternate embodiments are possible wherein the microprocessor controls the message recorder directly, or indirectly through a circuit component other than the message controller.

The control signals generated by the microprocessor in response to various input sequences initiate various operating functions of the toy telephone. Among the functions performed by the teaching telephone of the preferred embodiment are the recording of a personalized message, and the programming of a user's telephone number. These functions allow a parent or supervisory adult to program a child's home telephone number into the toy telephone and record a greeting or congratulatory message to be played back when the child correctly enters the programmed number. Thus, the toy telephone will help a child learn the programmed telephone number by providing positive reinforcement whenever the correct number is entered into the keypad. Thus, when a child dials her home telephone number to talk to her mother or father, the teaching telephone can be configured to answer in the voice of the child's mother or father voice, thereby providing strong positive reinforcement that the child is using the telephone correctly. Later the telephone can be re-configured to teach other telephone numbers such as the child's grandmother's telephone number. Again, if the child correctly enters Grandmother's telephone number, and the telephone responds in Grandmother's voice, a strong association will be formed in the child's mind between Grandmother's telephone number and speaking with Grandmother over the telephone.

As an additional reinforcing tool, the numbers entered into the keypad are displayed on the liquid crystal display as they are entered. Thus, the child can visualize the proper sequence of digits as they are entered into the toy telephone. A compartment is also provided wherein important numbers may be written and stored. Thus, a child may compare the numbers displayed on the telephone against those written and stored in the compartment to ensure that numbers are entered correctly.

Additional functions, messages, and meaningful input pushbutton sequences may be pre-programmed permanently into the teaching telephone. For example, a teaching toy telephone may be provided wherein pressing the "0" button will cause a pre-recorded operator message to be played, or wherein entering "911" may elicit an appropriate emergency response in order to teach a child how to call for emergency assistance. Any number of alternate input combinations or messages may also be provided, such as emergency assistance number employed in foreign countries.

Other, more entertaining functions, may also be provided to help maintain a child's interest in the toy telephone. For example, various messages or tones or combinations thereof may be played in response the pressing the "*" and "#" buttons. Also, the telephone can be configured such that the "Speed Dial" buttons will cause random pre-recorded fun messages to be played indicating to a child that the telephone may be used to contact many different locations, such as friends, the library and so forth. Thus, the toy telephone of the present invention facilitates a child's memorization of important telephone numbers while helping to teach the child important skills as to the operation and use of a telephone in a fun and engaging manner.

DETAILED DESCRIPTION OF THE PREFERRED EMBODIMENT

Figure 1:
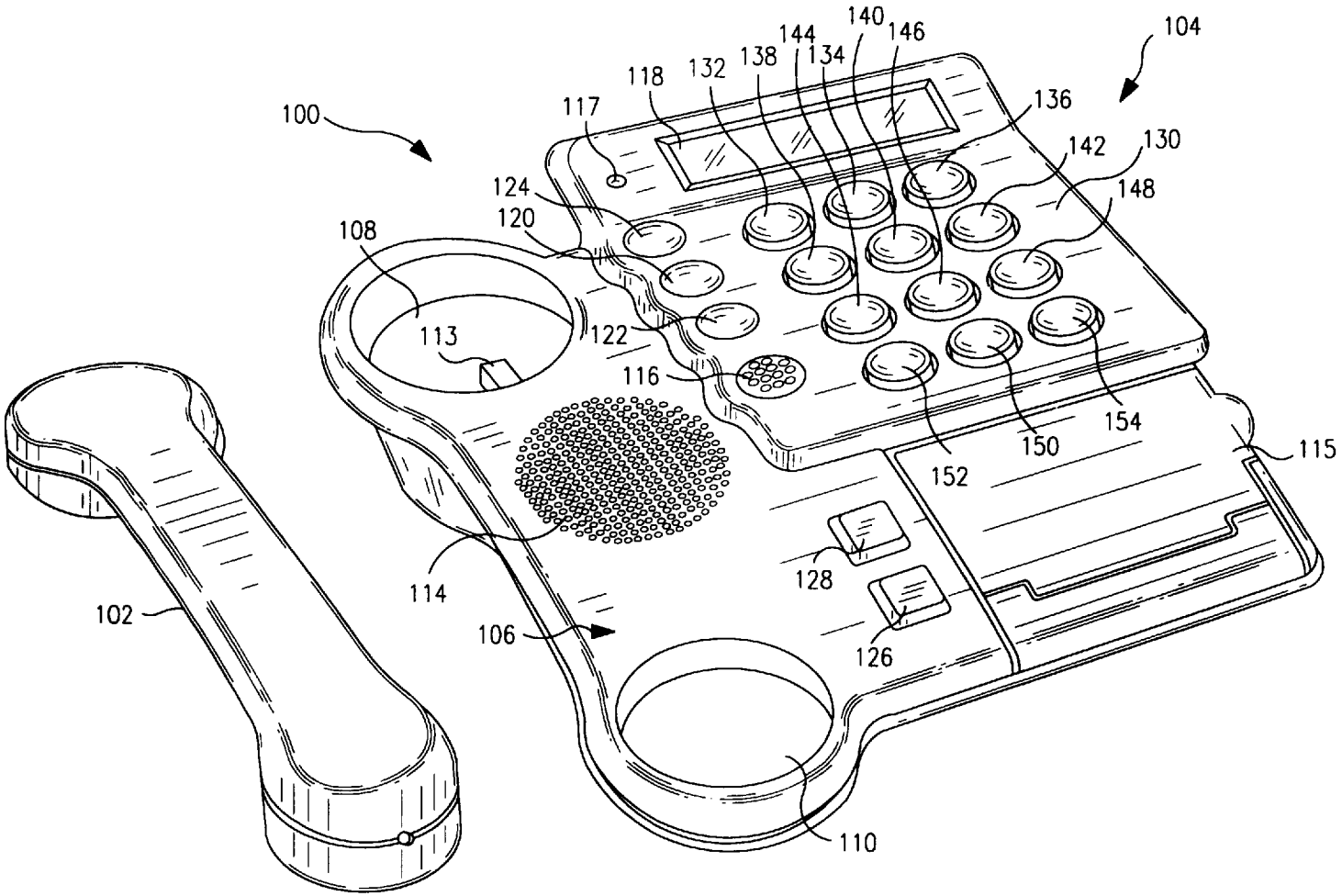
FIG. 1 is a perspective view of a teaching toy telephone according to the preferred embodiment of the invention.

Referring to FIG. 1 a teaching toy telephone according to the preferred embodiment of the invention is shown at 100. The toy telephone includes a removable handset 102 and a base 20 104. The base includes a cradle 106 formed of an upper recessed area 108 and a lower recessed area 110. Upper and lower recessed areas 108, 110 are positioned to receive mating portions of the handset 102 when it is placed in the cradle 106 and when toy telephone 100 is not in use. A cradle switch 112 (see FIG. 3) includes an actuator 113, which protrudes into upper recessed area 108. Handset 102 engages actuator 113 when the handset is placed in cradle 106 such that switch 112 provides indication whether handset 102 has been placed in cradle 106.

Base 104 further includes a speaker 114, a microphone 116, an LED 117, a liquid crystal display (LCD) 118, a paper compartment 115 to store important telephone numbers in writing, and a plurality of input buttons. Input buttons include Speed Dial buttons 120, 122, On/Off button 124, Program button 126, Record button 128, and a standard twelve button telephone keypad 130. Keypad 130 comprises discrete input buttons representing digits 1–9, "0", "*", and "#" identified by reference numbers 132–154 respectively.

In operation telephone 100 is turned on and off by alternately pressing the On/Off button 124. When telephone 100 is turned on LED 117 is illuminated. If the telephone is left idle for more than ten seconds, meaning that none of the input pushbuttons change state during such ten second period, the telephone will automatically turn itself off, removing power to the telephone's electronic circuitry, and extinguishing LED 117.

When telephone 100 is turned on and handset 102 is removed from cradle 106, a dial tone is played over speaker 114. Again, if the telephone is left idle for more than ten seconds, the telephone will automatically shut itself off.

The remaining functions of toy telephone 100 all must occur with handset 102 removed from cradle 106, just as the handset of an actual telephone must be removed from its cradle prior to placing a call.

When Speed Dial A button 120 is pressed while the dial tone is sounding, a seven tone pattern mimicking the touch-tone pattern of a real telephone is played over speaker 114. The seven tone pattern is followed by two ringing tones, followed by a message randomly selected from a first group of three pre-recorded speed dial messages.

When Speed Dial B button 122 is pressed while the dial tone is sounding, a seven tone pattern is sounded, followed by two ringing tones, followed by a message randomly selected from a second group of three pre-recorded speed dial messages.

When the "0" button 150 is pressed while the dial tone is sounding, the number "0" will be displayed on display 118. If no other button is pressed within three seconds following the pressing of the "0" button 150, two ringing tones will sound, followed by a pre-recorded operator message.

When the "*" button 152 is pressed while the dial tone is sounding, two ringing tones will sound over speaker 114.

When the "#" 154 button is pressed while the dial tone is sounding, a telephone number programmed into the telephone by a parent or other supervising adult will be displayed on display 118. (The procedure for programming a telephone number is described below). Simultaneously, a busy signal will be sounded over the speaker 114.

Finally, telephone numbers may be entered by sequentially pressing the buttons 132–150 corresponding to each digit of the telephone number being entered. As each button is pressed a key tone sounds over speaker 114 and the depressed digits comprising the telephone number are displayed on display 118. If an incorrect number is entered, the handset 102 may be replaced in cradle 106 or the cradle switch actuator 113 may be manipulated manually to clear display 118 and reset the telephone. When handset 102 is again removed from cradle 106 or the cradle switch actuator released, the dial tone sounds again, and another number may be entered. When the number "911" is entered, an emergency message is played. When a programmed telephone number is entered, a pre-recorded personalized greeting or congratulatory message recorded by a parent or supervising adult is played over speaker 114. (The procedure for recording the personalized message is described below.)

As noted above, an adult may program a child's home telephone number, or some other telephone number having significance to the child, into the telephone. The program mode is entered by pressing and holding down the program button 126 concurrently with pressing and releasing the "#" button 154. Once in program mode, the adult user may enter a series of digits by pressing the appropriate numbered buttons 132–150 corresponding to the telephone number to be programmed. In the preferred embodiment of the invention, the programmed number may not exceed eleven digits. Upon entering the entire number, the program button may be released, whereupon the telephone exits the program mode. Once entered, the programmed number may be verified by pressing the "#" button 154, causing the programmed number to be displayed on display 118. If an error entering the number has occurred, the error may be corrected by re-programming the number.

For recording a personalized message to be played when the programmed number is correctly entered into keypad 130, both the Program button 126 and the Record button 128 must be pressed and held down simultaneously. After a three second pause, a tone is sounded over speaker 114 and recording begins. Upon hearing the tone, the user recording the message may begin speaking into microphone 116. The recorded message may be up to twelve seconds long. However, recording will stop as soon as either the record button 128 or the program button 126 is released so that the recorded message may be less than twelve seconds long.

Figure 2:
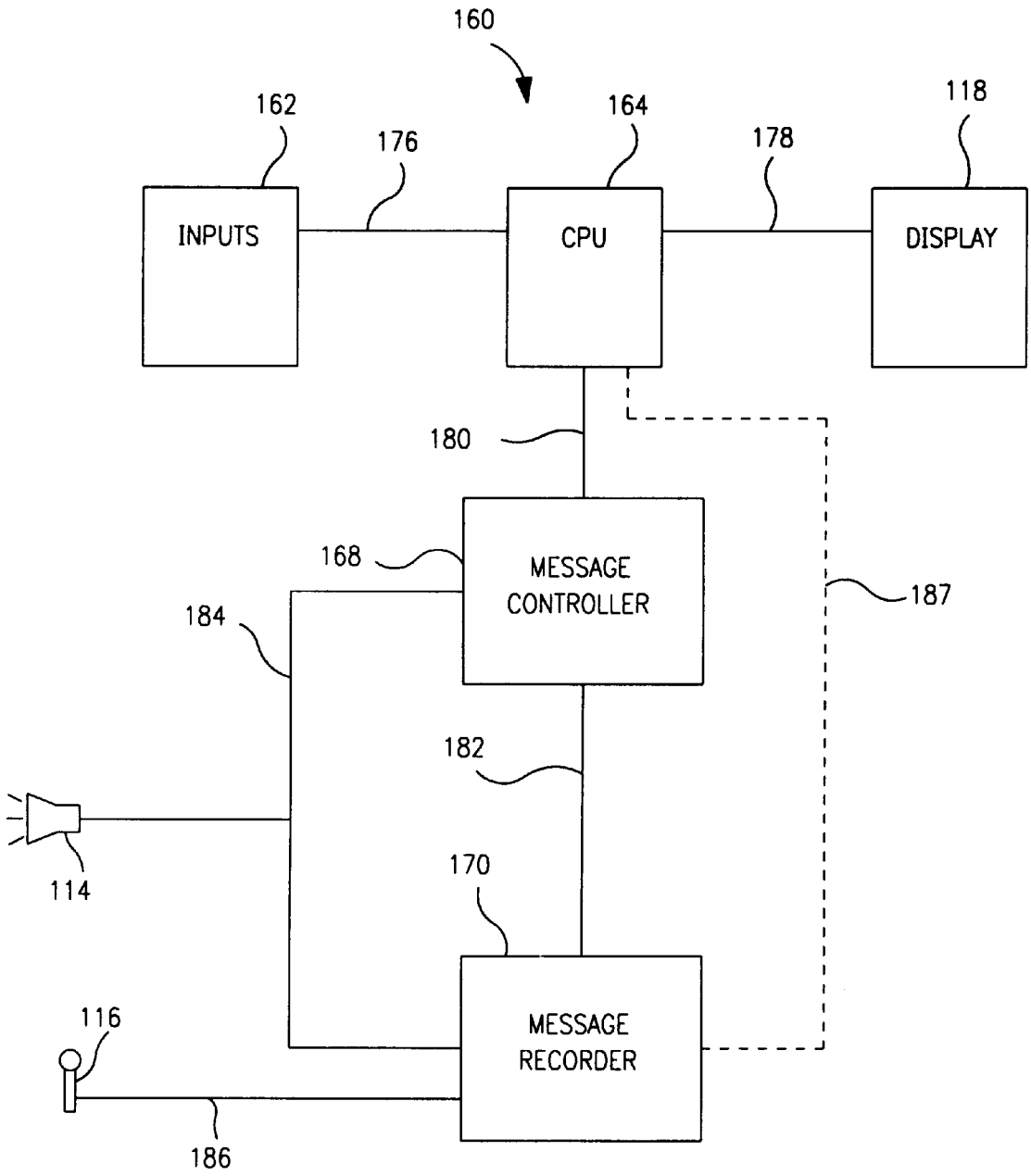
FIG. 2 is a functional block diagram of the preferred embodiment of the teaching toy telephone of the present invention.

Turning to FIG. 2, a functional block diagram of the preferred embodiment of the teaching toy telephone of the present invention is shown at 160. Functionally, the telephone comprises a plurality of inputs 162, a central processing unit (CPU) 164, display 118, a message controller 168, a message recorder 170, speaker 114, and microphone 116.

Inputs 162 comprise the pushbutton switches 120–154 located on the face of telephone 104 and described in reference to FIG. 1, as well as switch 112 actuated by cradle switch actuator 113. Inputs 162 are operatively connected to CPU 164 as indicated by connection 176.

The CPU 164 drives display 118 and message controller 168 in response to input data received from inputs 162. The operative connections between CPU 164, display 118 and message controller 168 are shown as connections 178 and 180 respectively. CPU 164 also acts to record and store the user programmed telephone number. In the preferred embodiment, CPU 164 does not control message recorder 170 directly, but rather CPU 164 controls message recorder 170 indirectly through message controller 168 as evidenced by connections 180 and 182. However, those skilled in the art will recognize that CPU 164 may be readily configured to control message recorder 170 directly as shown by alternate dashed connection 187. Further, it is also possible that the functions performed by the message controller and message recorder may be combined into a single component with which CPU 164 interfaces directly, or these functions may be included within CPU 164 itself.

The interaction between CPU 164 and display 118 is such that as numbers are entered on the push button keypad 130 located on the face of the toy telephone (see FIG. 1), the corresponding numbers are displayed on display 118.

Message controller 168 stores pre-recorded messages, and on command from CPU 164, plays select messages back over speaker 114. The messages stored by message controller 168 may comprise any combination of tones, patterns of tones, or voice messages. For example a message may comprise a single tone such as a busy signal, a series of tones such as a number of telephone rings, or a combination such as a random pattern of tones representing different keys being pressed on keypad 130 (see FIG. 1) followed by a series of rings, followed by a voice message. In operation, CPU 164 determines which message, if any, is to be played back by message controller 168 and sends the appropriate signal to the message controller commanding message controller 168 to reproduce the selected message. Upon receiving the signal from CPU 164, message controller 168 sends an audio signal over connection 184, which is broadcast by speaker 114.

In addition to storing and playing back pre-recorded messages, message controller 168 also controls message recorder 170. Again, in response to a control signal from CPU 164, message controller 168 commands message recorder to either record a new message, play back a saved message, or erase the message presently stored in the message recorder. The commands to message recorder 170 are shown as connection 182. When recording a new message, message recorder 170 receives a signal from microphone 116 via connection 186, and stores the signal in its own internal memory. When playing back the message, message recorder 170 retrieves the signal and outputs the signal to speaker 114 over connection 184.

Figure 3:
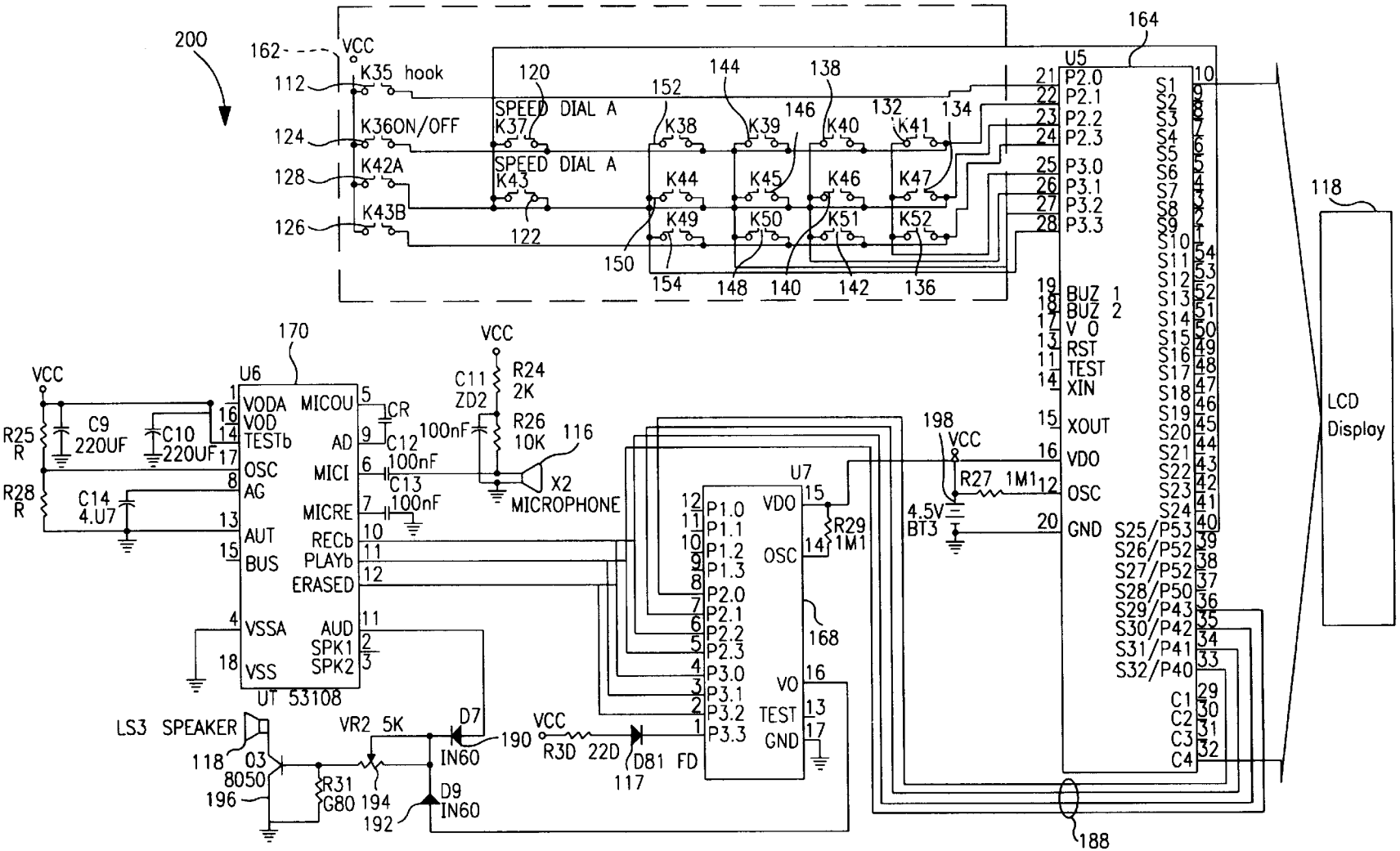
FIG. 3 is a simplified electrical schematic diagram of the preferred embodiment of the teaching toy telephone of the present invention.

Turning now to FIG. 3, a schematic diagram of a toy telephone implementing the functional block diagram of FIG. 2 is shown at 200. Like components previously described with reference to FIGS. 1 and 2 have been given identical reference numbers in FIG. 3. Therefore, inputs 162 include on/off button 124, cradle switch 112, record button 128, program button 126, Speed Dial buttons A and B 120, 122, and keypad buttons 132–154. In the preferred embodiment CPU 164 comprises a microprocessor manufactured by Sonix Corp. part no. SN69040M. As shown, inputs 162 are multiplexed onto four discrete inputs P20, P21, P22, and P23 of CPU 164. CPU outputs (insert S1-S32 and C1–C4) drive LCD display 118, and outputs P 4/0, P 4/1, P 4/2, and P 4/3 comprise the CPU 164 output signal 188 driving message controller 168. Output signal 188 comprises a parallel four bit signal input to message controller 168.

In the preferred embodiment, message controller 168 comprises a sound synthesis chip manufactured by Sonix Corp. part no. SN67060. Message controller 168 includes an integral memory in which a plurality of digitally coded messages may be stored. In the toy telephone of the present invention, the messages stored in message controller 168 include a dial tone, an alarm tone, a ringing telephone tone, a busy signal, a touch tone button sound, six pre-recorded speed dial messages, an operator message and an emergency message. These messages may be recorded and permanently stored in message controller 168 at the manufacturing facility prior to shipping the final product. Message controller 168 further includes an internal digital/analog ("DIA") converter coupled to analog output VO, which in turn is coupled to speaker 114.

The individual messages stored in message controller 168 are selected for playback by CPU output signal 188. Signal 188 comprises a four-bit word input to message controller 168. Thus, CPU 164 can send up to sixteen commands to voice controller 168. Message controller 168 is configured such that each of the sixteen commands, received via signal 188, will initiate a different function within the message controller. For example, message controller 168 may be configured such that signal 188 transmitting the binary combination 0001 may trigger the message controller to play back a dial tone. Similarly, the message controller may be configured such that the combination 0101 will trigger message controller 168 to playback one of the pre-recorded speed dial messages, and so forth. The preceding examples should be viewed as examples only, and should not be construed as limiting the invention in any way. The message controller may be configured such that any input combination from signal 188 may trigger any desired response. However, each pre-recorded message stored in message controller 168 will have a unique CPU output command associated therewith such that each message will be played back over analog output VO to speaker 114 in response to the proper command from CPU 164.

In addition to playing back pre-recorded messages, message controller 168 also controls message recorder 170. In the preferred embodiment of the invention, voice recorder 170 comprises a single integrated speech recorder manufactured by Utron Technology, Inc., part no. UT53108. Message recorder 170 includes an internal microphone amplifier, D/A converter and static SRAM. Message recorder 170 is provided to record and play back the personalized message which is to be sounded when a child playing with toy telephone 100 correctly enters the programmed telephone number. Inputs and outputs to message recorder 170 include an analog microphone input, an analog audio output, and binary inputs Record, Play, and Erase.

Message controller 168 controls message recorder 170 via the three binary inputs Record, Play, and Erase. As would be expected, when the message controller sets the Record input high, voice recorder 170 records the analog signal supplied by microphone 116. As the user enunciates the personalized message, an AID converter converts the analog microphone voice signal to a digital signal which is stored in the message recorder's SRAM memory. Similarly, when message controller 168 sets the Play signal high, the digital message stored in the message recorder's SRAM memory is converted back to an analog signal and output via the voice recorder's analog output AUD for broadcast over speaker 114.

Both message controller 168 and voice recorder 170 output audio signals are connected to speaker 114. Therefore, diodes 190, 192 are placed in the analog output circuits of both message controller 168 and voice recorder 170 in order to prevent each output circuit from reverse feeding the other. A 5K volume control potentiometer 194 is provided in the speaker output circuit, as is output amplifier 196.

Other miscellaneous circuit features shown in FIG. 3 include a 4.5v battery power source 198 and various biasing resistors and filtering capacitors associated with voice recorder 170 and microphone 114. Power-on indicating LED 117 is connected between the positive supply voltage Vcc and pin P3.3 of message controller 168. Thus, LED 117 draws current and is illuminated when Vcc is present and message controller 168 is powered up. The electronic components and circuitry shown in FIG. 3 are mounted on a printed circuit board (not shown) housed within the base 104 of toy telephone 100.

It should be noted that various changes and modifications to the present invention may be made by those of ordinary skill in the art without departing from the spirit and scope of the present invention, which is set out in more particular detail in the appended claims. Furthermore, those of ordinary skill in the art will appreciate that the foregoing description is by way of example only, and is not intended to be limiting of the invention as described in such appended claims.

The invention claimed is:

1. A toy telephone adapted to teach children how to operate a telephone and to facilitate memorization of important telephone numbers, the toy telephone comprising:

a keypad including a plurality of switches; a message recorder; a message controller; a speaker; a microphone; and a microprocessor;

said keypad switches connected as inputs to said microprocessor;

said microprocessor configured to receive input data in the form of both sequential and contemporaneous entries manually entered through said keypad switches, said microprocessor further configured to generate one of a plurality of output control signals, each individual output control signal being associated with a unique predefined sequence of pushbutton entries corresponding to a conventional telephone number, said output control signal operatively connected to at least one of said message controller and said voice recorder, such that in response to various said pre-defined pushbutton sequences corresponding to the entering of a conventional telephone number through said keypad switches, voice messages are recorded and pre-recorded messages are selectively reproduced over said speaker.

2. The toy telephone of claim 1 further comprising a base and a removable handset, said base forming a cradle for receiving said handset, and wherein a switch actuable by said handset is located within said cradle and is further connected as an input to the microprocessor.

3. The toy telephone of claim 1 wherein said keypad switches are discrete pushbuttons each bearing a unique indicium.

4. The toy telephone of claim 1 wherein said message controller controls a plurality of pre-recorded stored messages, said message controller being configured to selectively cause the reproduction of individual pre-recorded messages in response to pre-defined control signals from said microprocessor.

5. The toy telephone of claim 1 wherein said pre-recorded messages comprise at least one of tones, patterns of tones, and voice messages.

6. The toy telephone of claim 3 further comprising a program pushbutton switch connected as an input to said microprocessor and said microprocessor including a programmable memory, said microprocessor entering a program mode to store a subsequently entered sequence of multiple keypad entries corresponding to a conventional telephone number within a said memory when said program button is depressed in conjunction with another designated keypad pushbutton.

7. The toy telephone of claim 6 further comprising a record pushbutton switch connected as an input to said microprocessor, said microprocessor being configured to generate a record signal when said record pushbutton is depressed in conjunction with another designated keypad pushbutton, said message recorder being responsive to said record signal to record a subsequent voice message spoken into said microphone.

8. A toy telephone comprising:

a keypad by which a telephone number may be entered into said telephone;

means for permanently storing a pre-set telephone number;

means for erasibly storing a user-programmed telephone number;

means for recording and storing a user voice message: means for storing a pre-recorded message, said pre-recorded message comprising at least one of individual tones, patterns of tones, and a voice message;

means for comparing an entered telephone number to said pre-set telephone number and for comparing an entered telephone number to said user-programmed telephone number; and means responsive to said comparison means for audibly reproducing said pre-recorded message when said comparison means determines that said entered telephone number matches said pre-set telephone number, and said reproduction means audibly reproducing said user voice message when said comparison means determines that said entered telephone number matches said stored telephone number.

9. The toy telephone of claim 8 further comprising a display whereon individual digits of said entered telephone number are displayed as the pushbuttons corresponding to said digits are pressed.

10. A toy telephone comprising:

a keypad by which an input telephone number may be entered into said telephone;

means for permanently storing a plurality of pre-set telephone numbers;

means for storing a plurality of pre-recorded messages, said pre-recorded messages comprising at least one of individual tones, patterns of tones and a voice message;

means for associating on a one-to-one basis each of said pre-recorded messages with one of said pre-defined telephone numbers;

means for comparing said input telephone number to said pre-defined telephone numbers;

means for reproducing said pre-recorded messages responsive to said comparison means such that upon said comparison means determining that said input telephone number matches one of said plurality of pre-defined telephone numbers, said reproducing means audibly reproduces the pre-recorded message associated with the matched pre-defined telephone number.

11. The toy telephone of claim 10 further comprising:

means for storing a user-programmed telephone number; and means for recording and storing a user voice message;

said comparison means further comparing said input telephone number to said user programmed telephone number; and said reproducing means audibly reproducing said user voice message when said comparison means determines that said input telephone number matches said user-programmed telephone number.

12. The toy telephone of claim 11 further comprising a base unit and a removable handset, said base unit including a cradle for receiving the handset, and an override switch actuated when said handset is placed in said cradle, said reproducing means being disabled during those periods when said override switch is actuated.

13. A teaching toy telephone comprising:

a keypad for entering telephone numbers;

a plurality of stored telephone numbers;

a plurality of stored audio messages;

a microprocessor responsive to said keypad configured to compare telephone numbers manually entered into said keypad to said stored telephone numbers; and a message controller configured to reproduce one of said stored messages associated with one of said plurality of stored telephone numbers when said microprocessor determines that a telephone number input into said keypad matches one of said stored telephone number.

14. A method of teaching a child how to dial a telephone number comprising the steps of:

providing a toy telephone having the appearance of a real telephone, including a handset, a base, a keypad, a microprocessor, a microphone, voice message storage means, programmable telephone number storage means and a speaker;

entering a telephone number into said programmable telephone number storage means;

storing a voice message within said voice storage means;

allowing said child to enter numbers into said key pad;

comparing the numbers entered into the keypad against the telephone number stored in said programmable telephone storage means;

playing the voice message stored in said voice storage means when it has been determined that the numbers entered into the keypad match the telephone number stored in said programmable telephone number storage means.

15. A toy telephone adapted to teach children how to operate a real telephone and to facilitate memorization of important telephone numbers, the toy telephone comprising:

a plurality of pushbutton switches, including a first speed dial button; a message recorder; a message controller; a speaker; a microphone; a microprocessor; and a memory;

a plurality of prerecorded messages, including a first plurality of speed dial messages, stored in said memory, each massage comprising at least one of tones, patterns of tones, and voice messages;

said pushbutton switches being connected as inputs to said microprocessor, whereby said microprocessor receives input data in the form of both sequential and contemporaneous entries manually entered through said pushbutton switches, said microprocessor being configured to generate various output control signals operatively connected to at least one of said message controller and said voice recorder such that in response to pre-defined pushbutton sequences entered through said pushbutton switches, voice messages are recorded and individual said pre-recorded messages are selectively reproduced over said speaker;

said microprocessor being further configured to generate a play speed dial message command associated with a randomly selected one of said first plurality of speed dial messages in response to receiving an input from said first speed dial pushbutton, said message controller reproducing said randomly selected one of said first plurality of speed dial messages in response to said play speed dial message command.

16. The toy telephone of claim 15 further comprising a second speed dial button, and said pre-recorded stored messages comprising a second plurality of speed dial messages said microprocessor being further configured to generate a play speed dial message associated with a randomly selected one of said second plurality of speed dial messages in response to receiving an input from said second speed dial pushbutton, said message controller reproducing said randomly selected one of said second plurality of speed dial messages in response to said play speed dial massage command.

17. A toy telephone adapted to teach children how to operate a real telephone and to facilitate memorization of important telephone numbers, the toy telephone comprising:

a microprocessor having a programmable memory;

a keypad comprising a plurality of pushbutton switches including a program pushbutton switch and a record pushbutton switch, each said pushbutton switch bearing a unique indicium;

a message recorder, a message controller, a speaker, and a microphone;

said microprocessor being configured to receive input data in the form of both sequential and contemporaneous entries manually entered through said keypad pushbutton switches, said microprocessor entering a program mode upon receiving simultaneous inputs from said program switch and a second designated keypad pushbutton switch, wherein said microprocessor acts to store a subsequently entered sequence of keypad entries representing a telephone number in said memory;

said microprocessor also being configured to generate a record signal upon receiving simultaneous inputs from said record pushbutton switch and another designated pushbutton switch, said message recorder being responsive to said record signal to record a user's message subsequently spoken into said microphone;

said microprocessor generating a plurality of output control signals operatively connected to said message controller and said voice recorder such that in response to pre-defined pushbutton sequences entered through said keypad switches, said user's message or various said pre-recorded messages are selectively reproduced over said speaker, said microprocessor generating said play user's message signal upon receiving a keypad input sequence corresponding to the telephone number stored in said memory, said message recorder being responsive to said play said play user's message signal to reproduce the user's message.

18. A toy telephone adapted to teach children how to operate a real telephone and to facilitate memorization of important telephone numbers, the toy telephone comprising:

a keypad including a plurality of pushbutton switches, each bearing a unique indicium; a message recorder; a message controller; a speaker; a microphone; a microprocessor; and a memory;

wherein said keypad switches are connected as inputs to said microprocessor such that said microprocessor receives input data in the form of both sequential and contemporaneous entries manually entered through said keypad switches, said microprocessor generating a plurality of output control signals operatively connected to at least one of said message controller and said voice recorder, such that in response to predefined pushbutton sequences entered through said keypad switches, voice messages are recorded and pre-recorded messages are selectively reproduced over said speaker;

a plurality of keypad input sequences and a corresponding plurality of pre-recorded messages, each message being associated with a unique one of said keypad input sequences, said keypad input sequences and said pre-recorded messages being stored in said memory;

said microprocessor generating a particular one of a plurality of unique play pre-recorded message signals in response to a particular one of said plurality of stored keypad input sequences manually entered into said keypad, whereby said voice controller, responsive to said particular one of said plurality of unique play pre-recorded message signals, reproduces the particular one of said pre-recorded messages corresponding to the particular one of said plurality of stored keypad input sequences entered.

19. A toy telephone comprising:

a keypad by which an input telephone number may be entered into said telephone, said keypad including a first speed dial button;

means for permanently storing a plurality of pre-set telephone numbers;

means for storing a plurality of pre-recorded messages, including a first plurality of speed dial messages, said pre-recorded messages comprising at least one of individual tones, patterns of tones and a voice message;

means for associating on a one-to-one basis each of said pre-recorded messages with one of said pre-defined telephone numbers;

means for comparing said input telephone number to said pre-defined telephone numbers;

means for reproducing said pre-recorded messages responsive to said comparison means such that upon said comparison means determining that said input telephone number matches one of said plurality of predefined telephone numbers, said reproducing means audibly reproduces the pre-recorded message associated with the matched pre-defined telephone number, and said means for reproducing pre-recorded messages being responsive to said first speed dial button such that said reproducing means reproduces a message randomly selected from said first plurality of speed dial messages when said speed dial button is pressed.

20. The toy telephone of claim 19 further comprising a second speed dial button, said means for storing pre-recorded messages further storing a second plurality of speed dial messages, and said means for reproducing pre-recorded messages being responsive to said second speed dial button such that said reproducing means reproduces a message randomly selected from said second plurality of speed dial messages when said second speed dial button is pressed.

* * * * *